US005843247A

United States Patent [19]

Fukagawa et al.

[11] Patent Number: 5,843,247

[45] Date of Patent: Dec. 1, 1998

[54] EXTRUDED ARTICLES OF AGE-HARDENING ALUMINUM ALLOY AND METHOD FOR PRODUCTION THEREOF

[75] Inventors: Kazuyuki Fukagawa, Toyama-ken; Shoso Yamamoto, Kurobe; Hiroshi Chiba, Kurobe; Mitsunao Satomura, Kurobe; Kengo Kawase, Toyama-ken, all of Japan

[73] Assignee: YKK Corporation, Tokyo, Japan

[21] Appl. No.: 540,484

[22] Filed: Oct. 10, 1995

[30] Foreign Application Priority Data

Oct. 11, 1994 [JP] Japan ..... 6-270154

[51] Int. Cl.[6] ..... C22C 21/02

[52] U.S. Cl. ..... 148/702; 148/415; 148/440; 148/702

[58] Field of Search ..... 148/415, 702, 148/440

[56] References Cited

U.S. PATENT DOCUMENTS

| | | | |
|---|---|---|---|
| 1,945,297 | 6/1934 | Sterner-Rainer | 148/415 |
| 4,174,232 | 11/1979 | Lenz et al. | 148/2 |
| 5,045,131 | 9/1991 | Fortin et al. | 148/415 |

*Primary Examiner*—Patrick Ryan
*Assistant Examiner*—M. Alexandra Elve
*Attorney, Agent, or Firm*—Hill & Simpson

[57] ABSTRACT

A high-strength extruded article of an age-hardening aluminum alloy capable of educing an achromatic dark gray color after the anodizing treatment thereof and a method for the production thereof are disclosed. The method comprises subjecting an alloy billet comprising 0.9 to 3.0% by weight of Si, 0.3 to 0.6% by weight of Mg, less than 0.3% by weight of Fe, and the balance of Al and unavoidable impurities or an alloy billet comprising 0.005 to 0.1% by weight of Ti either alone or in combination with 0.001 to 0.02% by weight of B besides the components mentioned above to a soaking treatment at a temperature in the range of from 350° to 480° C. for 2 to 12 hours, extruding the soaked alloy billet at a billet temperature in the range of from 380° to 450° C., and subjecting the extruded alloy to an aging treatment at a temperature in the range of from 170° to 200° C. for 2 to 8 hours. By the use of this method, there is obtained an extruded article which contains precipitated metallic silicon particles uniformly distributed therein and including those of particle sizes in the range of from 0.1 to 2 μm in a proportion of not less than 85% of the total number of the precipitated particles and has the ability to educe a dark gray color of an achromatic color tone in consequence of a subsequent anodic oxidation thereof.

13 Claims, 2 Drawing Sheets

EXTRUDED ARTICLES OF AGE-HARDENING ALUMINUM ALLOY AND METHOD FOR PRODUCTION THEREOF

BACKGROUND OF THE INVENTION

1. Field of the Invention

This invention relates to aluminum alloy extruded articles or extruded profiles (materials shaped into a continuous form by extrusion) adapted to undergo anodic oxidation prior to use, and more particularly to extruded articles made of age-hardening aluminum alloy to be subjected to an integral coloring in gray and to be used in such interior and exterior building materials as sashes, curtain walls, and gates or in frames of such electric appliances as audio devices which by nature need ornamentality and to a method for the production thereof.

2. Description of the Prior Art

In the building grade extruded articles of aluminum alloy, those of the JIS (Japanese Industrial Standard) A6000 type, particularly the 6063 alloy, have been used prevalently because they exhibit ideal resistance to corrosion, possess high strength, and excel in malleability for extrusion or extrudability. These alloys generally undergo an anodizing treatment prior to use and they come in a silver color inherent in aluminum. For the sake of acquiring further exalted ornamentality, they are subjected to secondary electrolytic coloring in an electrolytic solution containing Ni, Co, Sn, or the like. The color consequently imparted thereto, however, is limited to one and the same bronze type color. There is much need also for building materials which come in varying colors other than the color mentioned above. In recent years, demands have been mounting particularly for the building materials which are in an achromatic or neutral gray color possessed of calm tone and substantial depth.

As alloys which are made to educe a gray color or to be naturally colored in gray by the anodizing treatment thereof, the Al—Fe alloys, the Al—Si alloys, or the Al—Mg—Si alloys adapted to harden by aging owing to the incorporation of magnesium therein have been known in the art. In the case of an alloy which contains Fe as a coloring element, for example, when it has its Fe content increased for the sake of darkening the color to be educed, the increased Fe content entails the disadvantage of degrading strength, giving rise to coarse and unevenly distributed grains of an Al—Fe compound in the matrix of alloy, and consequently damaging the uniformity of coloration of the alloy during the course of the anodic oxidation.

Then, in the case of an alloy which contains silicon as a coloring element, when it is heat-treated and extruded under ordinary conditions, the amount of fine silicon particles subsequently precipitated therein and expected to contribute to the integral coloring of the aluminum alloy is so small as to render desired darkening of color difficult. This darkening of color could be attained by increasing the thickness of an anodic oxide film of the alloy. This method, however, is at a disadvantage in sacrificing economy owing to consumption of unduly large electric power for the treatment of anodic oxidation and suffering proportionate growth of yellowish and reddish tint due to the increase in the thickness of the anodic oxide film and inevitably acquiring a color tone which is different from the achromatic color aimed primarily at by the method. Particularly, in the case of an age-hardening type alloy which incorporates magnesium therein, the precipitation of $Mg_2Si$ which occurs during the course of the aging treatment results in consuming silicon as a coloring element and rendering it difficult to accomplish uniform dispersion of fine precipitated silicon particles in the alloy matrix. This alloy, therefore, incurs extreme difficulty in acquiring desired color tone and color darkness, let alone strength, stability with good reproducibility owing to the interaction of such metallurgical factors as mentioned above.

SUMMARY OF THE INVENTION

It is a primary object of the present invention, therefore, to provide extruded articles or extruded profiles of an age-hardening aluminum alloy which are relieved of such problems as noted above, possessed of strength equal to that of the alloy which has undergone the T5 treatment according to JIS A 6063, and adapted to educe a dark gray color of an achromatic color tone in consequence of a subsequent anodizing treatment thereof.

A further object of the present invention is to provide a method which allows production, with high productivity, of high-strength extruded articles of an age-hardening aluminum alloy capable of educing a dark gray color of an achromatic color tone stably with good reproducibility after the anodizing treatment thereof.

To accomplish the objects mentioned above, in accordance with the present invention, there is provided a method for the production of an extruded article of an age-hardening aluminum alloy, which comprises subjecting an alloy billet comprising 0.9 to 3.0% by weight of Si, 0.3 to 0.6% by weight of Mg, less than 0.3% by weight of Fe, and the balance of Al and unavoidable impurities or an alloy billet comprising 0.005 to 0.1% by weight of Ti either alone or in combination with 0.001 to 0.02% by weight of B besides the components mentioned above to a soaking treatment at a temperature in the range of from 350° to 480° C. for 2 to 12 hours, extruding the soaked alloy billet at a billet temperature in the range of from 380° to 450° C., and subjecting the extruded alloy to an aging treatment at a temperature in the range of from 170° to 200° C. for 2 to 8 hours.

By the use of this m ethod, there is obtained an extruded article which contains precipitated metallic silicon particles uniformly distributed therein and including those of particle sizes in the range of from 0.1 to 2 $\mu$m in a propor tion of not less than 85% of the total number of the precipitated particles and has the ability to educe a dark gray color of an achromatic color tone in consequence of a subsequent anodic oxidation thereof.

The expression "achromatic dark gray color" as used in the present specification is defined as a color tone whose psychometric lightness L* (lightness: L star) and psychometric chroma coordinates a* (greenish to reddish tint: a star) and b* (bluish to yellowish tint: b star) expressed by the method of indicating the color of an object specified in JIS Z 8729 respectively fall in the ranges of $45<L^*<80$, $-1<a^*<1$, and $0<b^*<2$.

BRIEF DESCRIPTION OF THE DRAWINGS

Other objects, features, and advantages of the invention will become apparent from the following description taken together with the drawings, in which.

DETAILED DESCRIPTION OF THE INVENTION

Figure 1:
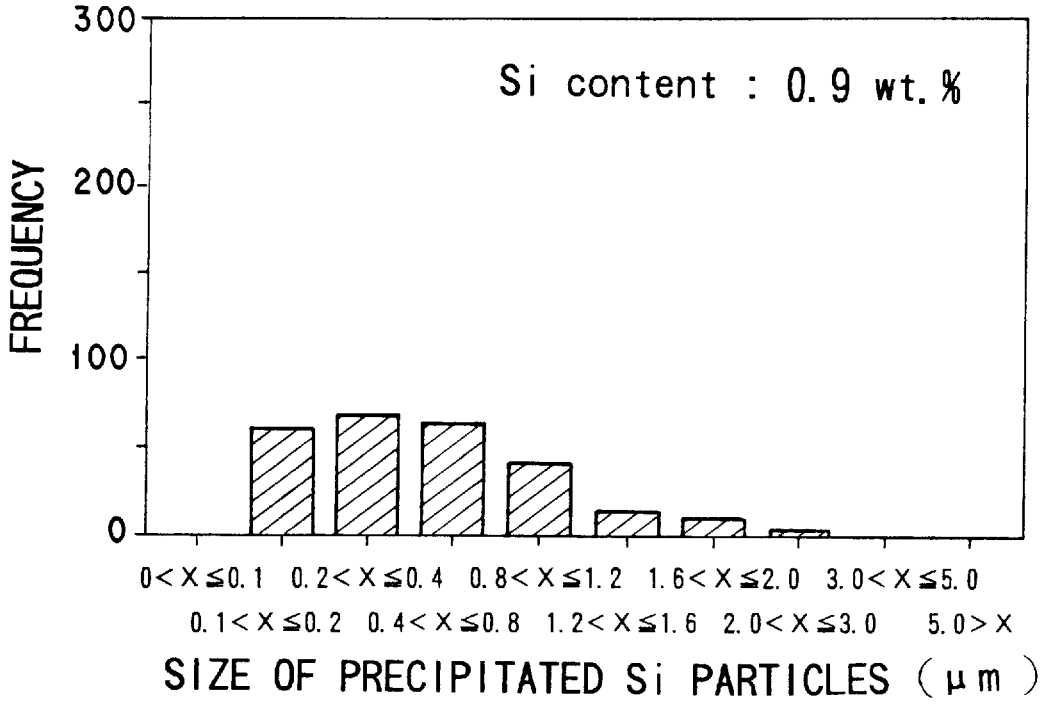
FIG. 1 is a graph showing the particle size distribution of precipitated silicon particles in an aluminum alloy extruded article produced from an alloy billet having a composition of Al-0.9 wt. % Si-0.55 wt. % Mg-0.15 wt. % Fe-0.01 wt. % Ti in accordance with the method of the present invention.

The present inventors, after continuing various tests and studies on an age-hardening aluminum alloy with a view to accomplishing the objects mentioned above, have found that the production of an extruded article of an age-hardening aluminum alloy exhibiting strength equal to that of the alloy which has undergone the T5 treatment as specified in JIS A6063 and moreover having the ability to manifest an achromatic dark gray color in consequence of a subsequent anodizing treatment thereof is attained by properly controlling the composition of the alloy and the method for production thereof.

To be specific, the characteristic features of the present invention reside in the facts that an alloy billet composed of 0.9 to 3.0% by weight of Si, 0.3 to 0.6% by weight of Mg, less than 0.3% by weight of Fe, and the balance of Al and unavoidable impurities or an alloy billet composed of 0.005 to 0.1% by weight of Ti either alone or in combination with 0.001 to 0.02% by weight of B besides the components mentioned above is used as a raw material and that the alloy billet is subjected to a soaking treatment at a temperature in the range of from 350° to 480° C. for 2 to 12 hours, to an extrusion at a billet temperature in the range of from 380° to 450° C., and then to an aging treatment at a temperature in the range of from 170° to 200° C. for 2 to 8 hours. The combination of the raw material (alloy billet) of this specific composition with the production conditions of heat treatments and extrusion within the specific ranges allows manufacture of an extruded article which contains precipitated metallic silicon particles uniformly distributed therein and including those of particle sizes in the range of from 0.1 to 2 $\mu$m in a proportion of not less than 85% of the total number of the precipitated particles and has the ability to educe a dark gray color of an achromatic color tone falling in the ranges of $45<L^*<80$, $-1<a^*<1$, and $0<b^*<2$ in consequence of the subsequent anodic oxidation thereof.

Now, the present invention will be described in detail below. The alloy billet to be used herein is composed of 0.9 to 3.0% by weight of Si, 0.3 to 0.6% by weight of Mg, less than 0.3% by weight of Fe, optionally plus 0.005 to 0.1% by weight of Ti either alone or in combination with 0.001 to 0.02% by weight of B, and the balance of Al and unavoidable impurities. The reasons for setting the limits on the metallic components as mentioned above will be described below.

Silicon (Si) is an important element for enabling an aging treatment to impart increased strength to the extruded article and, at the same time, allowing metallic Si particles to be uniformly distributed in an anodic oxide film during the course of subsequent anodic oxidation and contributing to the integral coloring of the extruded acticle in gray. Specifically, it warrants the strength of the extruded article by forming $Mg_2Si$ through bonding thereof with magnesium during the course of the aging treatment subsequent to the step of extrusion. Meanwhile, the remainder of Si, i.e. Si not used for forming $Mg_2Si$, is not oxidized by the subsequent anodizing treatment and persists in the form of metallic Si in the anodic oxide film. It is because this metallic Si absorbs light that the extruded article educes the gray color. For the purpose of this emission of the gray color, it is necessary that the alloy contains Si in an amount not less than 0.6 times the amount of Mg by weight stoichiometrically. To impart a darker color to the extruded article, the Si content is desired to be not less than 1.5 times the magnesium content by weight. The amount of Si which is to be incorporated in the alloy, therefore, should be not less than 0.9% by weight in view of the Mg content which will be more specifically described hereinafter. Conversely, if the Si content exceeds 3% by weight, the alloy will have insufficient resistance to corrosion although the degree to which the color is darkened is proportionately increased and will assume a color tone different from the achromatic color aimed at by the present invention because the oxide film resulting from the anodic oxidation gains in the yellowish tint.

Incidentally, the metallic Si in the alloy is classified into the Si particles crystallized out during the course of solidification of a cast alloy and the Si particles precipitated during the course of the soaking treatment. It is known that the crystallized Si particles have large sizes ranging from several $\mu$m to 30 $\mu$m and do not contribute to the integral coloring. In contrast, the precipitated Si particles generally have small particle diameters and amount to a large number, though depending on the conditions of the soaking treatment, and effectively function as points for absorption of the incident light. The present inventors, after deliberately studying the amount of Si added, the diameter of precipitated Si particles, and the degree to which the color is darkened, have acquired a knowledge that for the purpose of enabling Si existent only in a small amount to function most effectively and impart a dark gray color to the extruded article, the precipitated particles ought to include those of particle diameters in the range of from 0.1 to 2 $\mu$m in a proportion of not less than 85% of the total number thereof.

Figure 2:
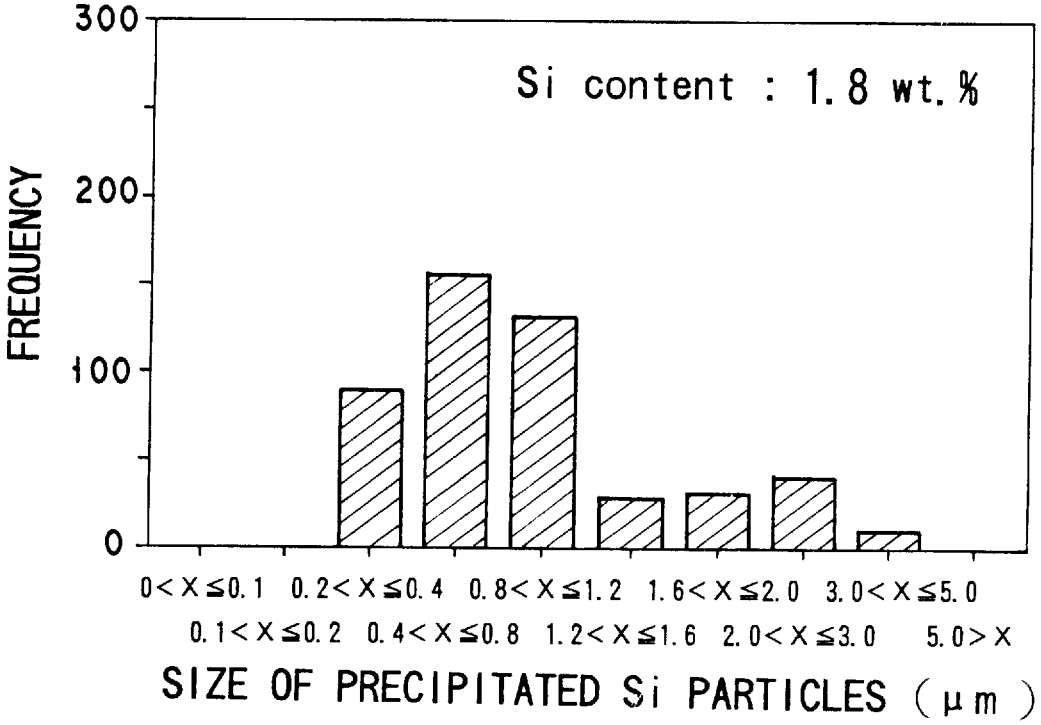
FIG. 2 is a graph showing the particle size distribution of precipitated silicon particles in an aluminum alloy extruded article produced from an alloy billet having a composition of Al-1.8 wt. % Si-0.55 wt. % Mg-0.15 wt. % Fe-0.01 wt. % Ti in accordance with the method of the present invention.
Figure 3:
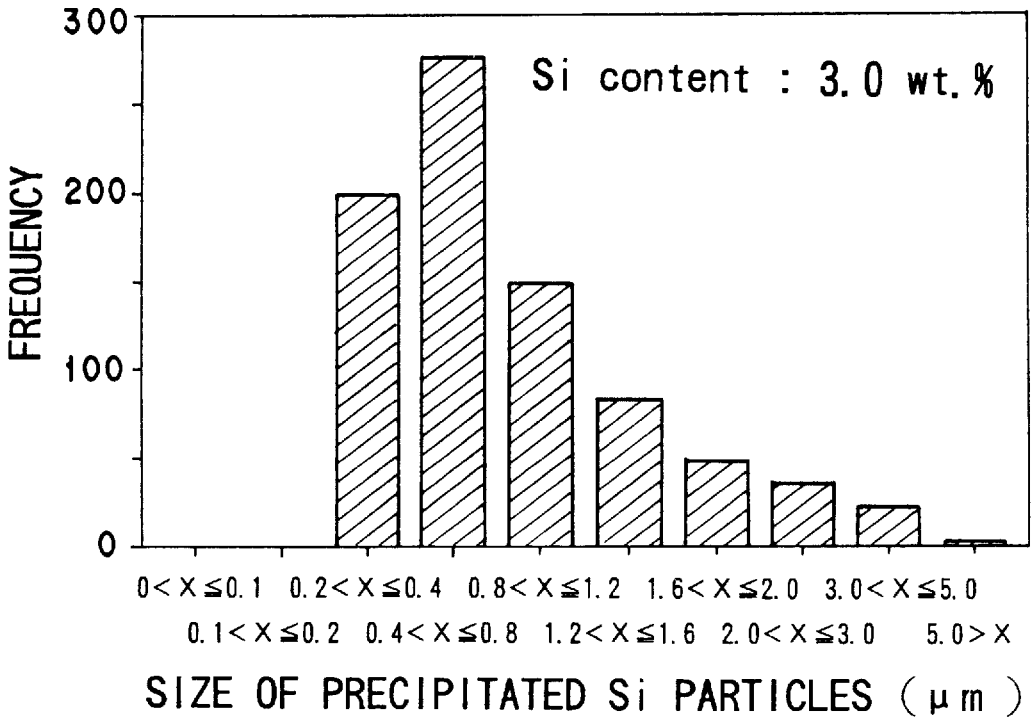
FIG. 3 is a graph showing the particle size distribution of precipitated silicon particles in an aluminum alloy extruded article produced from an alloy billet having a composition of Al-3.0 wt. % Si-0.55 wt. % Mg-0.15 wt. % Fe-0.01 wt. % Ti in accordance with the method of the present invention.

FIG. 1 through FIG. 3 show concrete examples of the analysis with a transmission electron microscope of the particle size distribution of precipitated Si particles in an aluminum alloy extruded article having a varying Si content. The particle diameter and the number of precipitated Si particles indicated therein were obtained by photographing several arbitrarily selected portions of a given sample through a transmission electron microscope, taking count of precipitated Si particles as classified by particle diameter, and totaling the counts. The extruded articles used for this analysis were each obtained by preparing an alloy billet composed of Al-xSi(x=0.9, 1.8, or 3.0 wt. %)-0.55 wt. % Mg-0.15 wt. % Fe-0.01 wt. % Ti, subjecting the alloy billet to a soaking treatment at 400° C. for 7 hours, extruding the soaked alloy billet at a billet temperature of 430° C., and then subjecting the resultant alloy to a T5 aging treatment at 190° C. for 4 hours. It is remarked from the diagrams that the precipitated particles having particle diameters in the range of from 0.1 to 2 $\mu$m invariably accounted for a proportion of not less than 85% of all the precipitated particles without reference to the variation in composition. When the precipitated Si particles include those having particle diameters of not less than 2 $\mu$m at a large proportion, the alloy educes a light gray color having a small degree of color darkening as compared with the alloys of FIG. 1 through FIG. 3. When the precipitated Si particles include those having particle diameters of less than 0.1 $\mu$m at a large proportion, the alloy assumes a yellowish color tone different from the achromatic gray color contemplated by the present invention. The uniform dispersion in the alloy of precipitated Si particles including those of particle diameters in the range of from 0.1 to 2 μm in a proportion of not less than 85% of the total number of precipitated Si particles as described above forms one of the salient features of the present invention.

Magnesium (Mg) constitutes an essential element for an age-hardening aluminum alloy and warrants the evolution of strength in the alloy owing to the precipitation of Mg in the form of $Mg_2Si$ during the final thermal aging treatment in the process of production. If the Mg content is less than 0.3% by weight, the alloy will not acquire strength equivalent to the material produced by the T5 treatment according to JIS A6063. The lower limit of the Mg content, therefore, should be set at 0.3% by weight. Conversely, if the Mg content exceeds 0.6% by weight, the excess, though contributing to increase strength, will extremely degrade the extrudability of the alloy and will entail the disadvantage that the precipitated $Mg_2Si$ particles are present in such a large amount in the anodic oxide film as to affect adversely the phenomenon of integral coloring and impart a yellowish tint to the color to be educed ultimately.

Iron (Fe) is incorporated in the alloy for the purpose of avoiding the phenomenon of cracking during the course of casting an alloy and improving the speed of casting. If it is incorporated in the alloy at a concentration of not less than 0.3% by weight, however, the excess will entail the disadvantage that it participates in the formation of coarse particles of an Al—Fe intermetallic compound, causes uneven coloration and impedes uniform evolution of color, and degrades strength. Thus, the upper limit of the Fe content should be set at 0.3% by weight. For the purpose of enabling the effect of the Fe addition to be fully manifested, the Fe content is desired to be not less than 0.01% by weight.

The present invention permits titanium (Ti) either alone or in combination with boron (B) to be incorporated in the alloy besides the components mentioned above for the purpose of ensuring fine division of crystal grains and consequently improving the extrusion workability of the alloy. Since the matrix alloy which contains Ti and B is expensive as compared with the ordinary aluminum alloy, the addition of Ti or B must be selected in due consideration of the economy of the use of these additional components. If the amount of Ti to be incorporated is less than 0.005% by weight, the effect of the addition mentioned above will not be manifested. Conversely, if the amount exceeds 0.1% by weight, the excess will possibly give rise to coarse $TiAl_3$ particles and produce streaks and recessions on the surface of the extruded article to the extent of spoiling the appearance of the product. Thus, the amount of Ti should be set in the range of from 0.005 to 0.1% by weight. The amount of B which is added in combination with Ti should be set in the range of from 0.001 to 0.02% by weight for the same reason as given above.

The alloy billet of the composition mentioned above is subjected to a heat treatment and a process of extrusion in accordance with the present invention. To be specific, the melt of an alloy of the composition mentioned above is cast as practiced popularly and the produced billet is then subjected to a soaking treatment at a temperature in the range of from 350° to 480° C. for a period of 2 to 12 hours, extruded at a billet temperature in the range of from 380° to 450° C., and subsequently subjected to an aging treatment at a temperature in the range of from 170° to 200° C. for 2 to 8 hours. As a result, there is obtained an aluminum alloy extruded article which contains precipitated metallic Si particles uniformly distributed therein and including those of particle sizes in the range of from 0.1 to 2 μm in a proportion of not less than 85% of the total number of the precipitated particles and has the ability to educe a dark gray color of an achromatic color tone in consequence of a subsequent anodic oxidation thereof. Now, the component steps of the process of production mentioned above will be described in detail below.

The step of the soaking treatment which follows the casting has an important role of causing Si forming a solid solution in the matrix of aluminum to be precipitated in the form of fine particles and enabling the alloy to educe a dark gray color during the subsequent course of anodic oxidation. It is important to accomplish the darkening of color most efficiently with a fixed amount of Si by selecting proper treating conditions thereby controlling the diameters of precipitated Si particles which contribute to the integral coloing. The treating temperature falling short of 350° C. proves improper in respect that, in the precipitated Si particles, those having particle diameters of less than 0.1 μm account for an excessively large proportion and the color tone to be educed in the alloy verges on assuming a yellowish tint. This unduly low treating temperature even has the possibility of coarsening the $Mg_2Si$ particles to be precipitated, with the result that the coarse precipitated particles will escape being redissolved in the alloy during the subsequent step of extrusion and go to lower the strength of the finally produced extruded article. Conversely, the treating temperature exceeding 480° C. promotes the reaction of precipitation of metallic Si, causes the particle diameters of the precipitated Si particles to grow beyond 2 μm, prevents the precipitated Si particles from contributing to educe a color any longer, and inevitably entails a decrease in the darkness of color to be educed even for a defined composition. The temperature of the soaking treatment, therefore, should be set in the range of from 350° to 480° C. and the treating time should be selected in the range of from 2 to 12 hours, according to the particular treating temperature. For the sake of obtaining a further stable color tone, the treating temperature is desired to be in the range of from 380° to 430° C. and the treating time in the range of from 5 to 10 hours.

The soaking treatment mentioned above is followed by a process of extrusion which is aimed at imparting a prescribed shape to the soaked alloy billet. In the process of this extrusion, the billet (cast mass) should be heated to acquire a good extrudability. The billet temperature falling short of 380° C. lacks practicability because it conspicuously degrades the extrudability of the billet. In contrast, the billet temperature exceeding 450° C. causes the fine Si particles once precipitated in the alloy in consequence of the soaking treatment to be redissolved in the alloy, with the result that the color tone educed in consequence of the subsequent anodic oxidation assumes a yellowish tint and, moreover, the overall color tone of the alloy is deprived of darkness. Thus, the heating temperature of billet during the extrusion should be set in the range of from 380° to 450° C.

The age-hardening alloy is characterized in that it acquires prescribed strength when it is subjected to a heat treatment at the final step in the molding of alloy and consequently enabled to promote the precipitation of $Mg_2Si$. In the case of the alloy of the present invention, it is important to set the conditions of treatment so as to satisfy both strength and color tone at the same time. Under the conditions of a temperature of less than 170° C. and a duration of less than two hours, for example, the $Mg_2Si$ is not fully precipitated and the strength equivalent to that of the alloy produced by the T5 treatment according to JIS A 6063 is not obtained. In contrast, when the aging treatment is carried out at a temperature exceeding 200° C. or for a duration exceeding eight hours, the precipitation of $Mg_2Si$ is promoted and the strength is fully increased. However, since the precipitated $Mg_2Si$ is destined to persist in a copious amount in the oxide film of the alloy resulting from the anodic oxidation, the color educed in the alloy is adversely effected so as to assume a yellowish tint and suffer impaired uniformity. If the treating temperature is heightened or the treating time elongated further, the strength of the alloy will be consequently degraded. Thus, the aging treatment should be carried out under the defined conditions of a temperature in the range of from 170° to 200° C. and a duration of from 2 to 8 hours. Within the ranges of conditions defined above, such treatments as two-stage aging may be carried out.

By regulating the composition of an alloy and the conditions of the extrusion and processing as described above thereby controlling the state of precipitation of Si in the alloy, there can be obtained an extruded article of an age-hardening aluminum alloy which exhibits strength equivalent to that of the alloy resulting from the T5 treatment according to JIS A6063 and possesses the ability to educe an achromatic dark gray color in consequence of the subsequent anodizing treatment thereof.

Now, the present invention will be described more specifically below with reference to working examples.

EXAMPLE 1

An alloy of a varying composition shown in Table 1 was produced by casting in a hot top type casting furnace, then subjected to a soaking treatment at 410° C. for seven hours, heated to a billet temperature of 400° C., and extruded into a prescribed shape. The resultant extruded article was subjected to an aging treatment at a temperature of 190° C. for four hours and then quickly subjected to an anodizing treatment. This anodizing treatment was carried out by the use of a sulfuric acid bath. The conditions for this anodizing treatment such as the concentration and the temperature of this bath and the current density used for the treatment, the pretreatment of the alloy, the treatment for sealing pores, etc. were in accordance with the method in popular practice. The treatment was adjusted so as to give a thickness of 20 μm of the anodic oxide film. The color tone assumed by a produced sample was reported in accordance with the method of indication which is specified in JIS Z 8729 and was rated on the basis of the definition mentioned above. As material characteristics, the resultant sample was tested for mechanical properties and the mechanical properties were rated in comparison with those of the material resulting from the T5 treatment according to JIS A 6063. As concerns the resistance of the anodic oxide film to corrosion, the sample was subjected to the CASS test as specified in JIS H 8601 and the results of the test were rated on the two-point scale, wherein an open circle, o, stands for resistance equivalent to the material resulting from the T5 treatment according to JIS A 6063 and a cross, x, for resistance inferior thereto. The results are shown in Table 2.

TABLE 1

| Classification | No. | Si | Mg | Fe | Al |
|---|---|---|---|---|---|
| Invention | 1 | 0.9 | 0.3 | 0.15 | Balance |
| | 2 | 3.0 | 0.3 | 0.15 | " |
| | 3 | 0.9 | 0.4 | 0.15 | " |
| | 4 | 1.8 | 0.4 | 0.15 | " |
| | 5 | 3.0 | 0.4 | 0.15 | " |
| | 6 | 0.9 | 0.55 | 0.15 | " |
| | 7 | 1.8 | 0.55 | 0.15 | " |
| | 8 | 3.0 | 0.55 | 0.15 | " |
| | 9 | 0.9 | 0.6 | 0.15 | " |
| | 10 | 3.0 | 0.6 | 0.15 | " |
| | 11 | 0.9 | 0.4 | 0.29 | " |
| | 12 | 3.0 | 0.4 | 0.29 | " |
| Comparative | 13 | 0.9 | 0.2 | 0.15 | " |
| Example | 14 | 1.8 | 0.7 | 0.15 | " |
| | 15 | 0.6 | 0.3 | 0.15 | " |
| | 16 | 3.5 | 0.4 | 0.15 | " |
| 6063 Alloy | 17 | 0.4 | 0.55 | 0.15 | " |

TABLE 2

| Classification | No. | Tensile strength, kgf/mm² | 0.2% Proof stress, kgf/mm² | Elongation, % | Color tone of produced anodic oxide film L* value | a* value | b* value | Resistance to Corrosion |
|---|---|---|---|---|---|---|---|---|
| Invention | 1 | 19.2 | 14.5 | 14.5 | 74.6 | −0.52 | 1.06 | ○ |
| | 2 | 19.4 | 14.6 | 14.6 | 55.6 | 0.21 | 0.60 | ○ |
| | 3 | 24.8 | 21.7 | 11.9 | 75.2 | −0.63 | 1.12 | ○ |
| | 4 | 24.7 | 20.7 | 12.9 | 62.3 | −0.23 | 1.20 | ○ |
| | 5 | 23.4 | 19.4 | 12.6 | 55.1 | 0.16 | 0.61 | ○ |
| | 6 | 24.3 | 21.5 | 10.1 | 78.7 | −0.70 | 0.97 | ○ |
| | 7 | 25.1 | 21.5 | 12.0 | 65.4 | −0.18 | 1.44 | ○ |
| | 8 | 24.1 | 20.2 | 12.0 | 52.6 | 0.03 | 0.59 | ○ |
| | 9 | 26.2 | 23.7 | 10.2 | 79.4 | −0.81 | 1.67 | ○ |
| | 10 | 25.8 | 23.5 | 11.1 | 50.6 | 0.06 | 0.71 | ○ |
| | 11 | 21.3 | 16.9 | 13.6 | 74.1 | −0.61 | 1.12 | ○ |
| | 12 | 21.5 | 17.2 | 13.2 | 56.1 | 0.18 | 0.58 | ○ |
| Comparative | 13 | 15.1 | 10.7 | 17.6 | 74.1 | −0.46 | 1.03 | ○ |
| Example | 14 | 27.7 | 25.1 | 10.3 | 63.1 | −0.85 | 2.15 | ○ |
| | 15 | 16.9 | 14.7 | 14.1 | 82.3 | −0.45 | 0.70 | ○ |
| | 16 | 24.2 | 21.3 | 11.8 | 43.2 | 0.20 | −0.31 | X |
| 6063 alloy | 17 | 22.5 | 20.1 | 11.8 | 86.1 | −0.30 | 0.15 | ○ |

It is clearly remarked from Table 2 that the extruded articles, Nos. 1 through 12, of the present invention invariably exhibited magnitudes of strength equivalent to that of the 6063 alloy and proved fully satisfactory in terms of both proof stress and elongation. The L*, a*, and b* values (indexes of color tone) obtained of these extruded articles fell in the respective ranges specified by the present invention and the magnitudes of resistance to corrosion were satisfactory.

In contrast, the sample No. 13 of Comparative Example, while having such a low Mg content as 0.2% by weight, exhibited a tensile strength of 15.1 kgf/mm$^2$, a magnitude not satisfying the strength (not less than 16.0 kgf/mm$^2$) of the 6063 alloy which has undergone the T5 treatment specified in JIS. The same remark holds good for the 0.2% proof stress.

The sample No. 14, while satisfying mechanical properties because of such a high Mg content as 0.7% by weight, assumed a color tone of a yellowish tint (b* value: 2.15) different from the achromatic color tone aimed at by the present invention because of an unduly large precipitation of $Mg_2Si$.

The sample No. 15 had such a low Si content as 0.6% by weight and, therefore, exhibited such a high magnitude as 82.3 for the L* value indicating color density and assumed a light color tone. This particular alloy could be made to assume a dark gray color by increasing the thickness of the anodic oxide film. Since the thickness of the anodic oxide film is in direct proportion to the amount of electric current used for the anodizing treatment as mentioned above, however, the increased thickness of this oxide film proves uneconomical because of unduly heavy electric power consumption.

The sample No. 16 had such a high Si content as 3.5% by weight and proved satisfactory in terms of both mechanical properties and color tone. Since it suffered copious occurrence of precipitated metallic Si particles in the anodic oxide film, however, it failed to offer the fully satisfactory resistance to corrosion which is aimed primarily at by the anodic oxide film.

EXAMPLE 2

Of the alloy compositions of the present invention shown in Table 1, alloys of Nos. 5, 6, and 8 were manufactured under the conditions shown in Table 3 below into the extruded articles. These extruded articles were tested for properties and the results were rated in the same manner as in Example 1. In addition, they were further tested to determine the extrudability of alloy and the proportion of precipitated Si particles having particle diameters in the range of from 0.1 to 2 $\mu$m to all the precipitated Si particles (the ratio by numbers of individual particles). The particle diameters and the quantities of the precipitated Si particles were determined herein by photographing several freely chosen portions of a given sample with the aid of a transmission electron microscope and taking count of individual precipitated Si particles as divided by particle diameter. The determination of extrudability was implemented by extruding a given alloy billet at a prescribed speed and visually examining the surface of the resultant extruded article to find the presence or absence of such flaws as recesses and pickups. A sample free from these flaws was rated as perfect in quality and acceptable. Incidentally, the anodizing treatment was carried out in the same manner as in Example 1. The results are shown in Table 4.

TABLE 3

| | | | Production conditions of extrusions | | |
|---|---|---|---|---|---|
| Classification | No. | Alloy used, No. | Soaking treatment (°C. × hr) | Billet heating temperature (°C.) | Aging treatment (°C. × hr) |
| Invention | 1 | 5 | 410 × 7 | 400 | 190 × 4 |
| | 2 | 5 | 380 × 10 | " | " |
| | 3 | 5 | 430 × 5 | " | " |
| | 4 | 5 | 410 × 7 | " | 180 × 5 |
| | 5 | 6 | " | " | 190 × 4 |
| | 6 | 6 | " | 380 | " |
| | 7 | 8 | " | 400 | " |
| | 8 | 8 | " | 450 | 200 × 3 |
| | 9 | 8 | " | " | 190 × 4 |
| | 10 | 8 | " | 380 | 170 × 7 |
| Comparative Example | 11 | 5 | 330 × 7 | 400 | 190 × 4 |
| | 12 | 6 | " | " | " |
| | 13 | 8 | " | " | " |
| | 14 | 5 | 500 × 7 | " | " |
| | 15 | 6 | " | " | " |
| | 16 | 8 | " | " | " |
| | 17 | 5 | 410 × 7 | 350 | " |
| | 18 | 6 | " | " | " |
| | 19 | 8 | " | " | " |
| | 20 | 5 | " | 500 | " |
| | 21 | 6 | " | " | " |
| | 22 | 8 | " | " | " |
| | 23 | 5 | " | 400 | 150 × 4 |
| | 24 | 6 | " | " | " |
| | 25 | 8 | " | " | " |
| | 26 | 5 | " | " | 220 × 4 |
| | 27 | 6 | " | " | " |
| | 28 | 8 | " | " | " |

TABLE 4

| | | | | | | Color tone of produced anodic oxide film | | | Ratio by | |
|---|---|---|---|---|---|---|---|---|---|---|
| Classification | Sample No. | Alloy used, No. | Tensile strength kgf/mm$^2$ | 0.2% Proof stress, kgf/mm$^2$ | Elongation, % | L* value | a* value | b* value | number % | Extrudability |
| Invention | 1 | 5 | 23.4 | 19.4 | 12.6 | 55.1 | 0.16 | 0.61 | 92 | ○ |
| | 2 | 5 | 22.6 | 19.2 | 12.2 | 54.9 | 0.18 | 0.66 | 90 | ○ |
| | 3 | 5 | 23.1 | 19.5 | 12.7 | 55.7 | 0.15 | 0.63 | 88 | ○ |
| | 4 | 5 | 22.7 | 19.4 | 12.6 | 55.2 | 0.16 | 0.62 | 91 | ○ |
| | 5 | 6 | 24.3 | 21.5 | 10.1 | 78.7 | 0.70 | 0.97 | 96 | ○ |
| | 6 | 6 | 23.9 | 20.9 | 10.6 | 78.0 | 0.68 | 1.03 | 94 | ○ |
| | 7 | 8 | 24.1 | 20.2 | 12.0 | 52.6 | 0.03 | 0.59 | 90 | ○ |
| | 8 | 8 | 22.9 | 19.8 | 12.6 | 52.9 | 0.05 | 0.67 | 86 | ◎ |
| | 9 | 8 | 24.3 | 20.2 | 11.9 | 52.4 | 0.02 | 0.63 | 86 | ◎ |
| | 10 | 8 | 22.3 | 19.5 | 12.5 | 52.8 | 0.06 | 0.80 | 87 | ○ |

TABLE 4-continued

| Classification | Sample No. | Alloy used, No. | Tensile strength kgf/mm$^2$ | 0.2% Proof stress, kgf/mm$^2$ | Elongation, % | Color tone of produced anodic oxide film L* value | a* value | b* value | Ratio by number % | Extrudability |
|---|---|---|---|---|---|---|---|---|---|---|
| Comparative Example | 11 | 5 | 17.4 | 14.9 | 14.9 | 43.2 | 0.07 | 5.23 | 82 | ○ |
| | 12 | 6 | 18.1 | 15.1 | 14.6 | 76.3 | 0.43 | 4.68 | 84 | ○ |
| | 13 | 8 | 17.9 | 15.0 | 14.8 | 41.6 | 0.02 | 4.85 | 82 | ○ |
| | 14 | 5 | 27.8 | 25.1 | 11.2 | 70.2 | 0.11 | 1.06 | 79 | ○ |
| | 15 | 6 | 27.1 | 25.5 | 11.7 | 79.5 | 0.51 | 2.33 | 74 | ○ |
| | 16 | 8 | 27.4 | 25.0 | 10.8 | 68.4 | 0.13 | 0.95 | 83 | ○ |
| | 17 | 5 | 15.9 | 13.1 | 15.3 | 53.3 | 0.11 | 0.83 | — | X |
| | 18 | 6 | 16.1 | 12.6 | 15.1 | 77.2 | 0.63 | 1.23 | — | X |
| | 19 | 8 | 16.4 | 13.2 | 15.6 | 50.8 | 0.08 | 0.86 | — | X |
| | 20 | 5 | 26.2 | 22.9 | 11.3 | 65.4 | 0.21 | 1.75 | — | ◎ |
| | 21 | 6 | 25.1 | 22.6 | 10.8 | 79.1 | 0.49 | 2.28 | — | ◎ |
| | 22 | 8 | 25.7 | 22.9 | 10.6 | 62.3 | 0.09 | 1.63 | — | ◎ |
| | 23 | 5 | 15.9 | 11.9 | 11.9 | 54.3 | 0.01 | 0.43 | — | ○ |
| | 24 | 6 | 15.5 | 12.1 | 12.1 | 77.6 | 0.59 | 0.76 | — | ○ |
| | 25 | 8 | 15.3 | 11.8 | 11.8 | 51.3 | 0.09 | 0.36 | — | ○ |
| | 26 | 5 | 18.1 | 15.1 | 15.1 | 53.6 | 0.35 | 1.23 | — | ○ |
| | 27 | 6 | 17.3 | 14.6 | 14.6 | 77.1 | 0.21 | 1.13 | — | ○ |
| | 28 | 8 | 17.1 | 14.7 | 14.7 | 50.7 | 0.27 | 1.31 | — | ○ |

The samples produced by the method according to the present invention and indicated as Samples, Nos. 1 through 10, in Table 4 exhibited mechanical properties equivalent to those of the 6063 alloy shown in Table 2, assumed color tones falling within the range specified by the present invention, and excelled in the extrudability which immensely affects the productivity.

In contrast, the samples, Nos. 11 through 13, of Comparative Examples adopted a low temperature for the soaking treatment, exhibited conspicuously large magnitudes for the b* value indicating yellowish tint as compared with those of the samples of the present invention, and assumed colors widely different from the achromatic gray color aimed at by the present invention. These differences originated in the fact that most precipitated metallic Si particles had diameters not exceeding 0.1 $\mu$m as mentioned above. Further, the samples of the Comparative Examples showed magnitudes of tensile strength 4 to 5 kgf/mm$^2$ lower than those of the samples of the present invention and could not be justly concluded as fully manifesting the properties of the extruded articles of the present invention having an identical alloy composition.

The samples, Nos. 14 through 16, were manufactured with the temperature of soaking treatment set at a high magnitude. Owing to the high temperature of treatment, the precipitated Si particles gained in growth and acquired large particle diameters and, as a result, the fine precipitated Si particles capable of contributing to the integral coloring proportionately decreased. Thus,the magnitudes of the L* value (indicating color density) exhibited by these samples were higher than those of the samples of the present invention (light color). This trend was especially conspicuous in the samples, Nos. 14 and 16, which showed differences in the L* value of not less than 10 from the samples (Nos. 1 and 7) of the present invention having an identical composition.

The samples, Nos. 17 through 19, were produced with the billet temperature set at a low magnitude during the course of extrusion. These samples were extremely deficient in the extrudability such that occasionally the relevant alloy billets even clogged the extruder. In consideration of actual production, the conditions of production adopted for these samples, therefore, were not proper in terms of productivity. As respects mechanical properties, the $Mg_2Si$ particles precipitated during the course of the soaking treatment could not be thoroughly redissolved in the alloy during the course of heating the billet. The samples, therefore, could not be made to acquire fully satisfactory strength even by the aging treatment performed at the final step.

The samples, Nos. 20 through 22, which adopted conversely heightened billet heating temperature exhibited good extrudability and nevertheless suffered the precipitated Si particles to start redissolving in the alloy, with the result that the alloy tended to acquire a light color tone as compared with the samples of the present invention having an identical alloy composition.

The samples, Nos. 23 through 28, were produced with the temperature of aging treatment varied. The samples which used such a low temperature of aging treatment as 150° C. assumed a satisfactory color tone and nevertheless exhibited tensile strength of not more than 16 kgf/mm$^2$, a magnitude not less than 6 kgf/mm$^2$ lower than the tensile strength of the samples produced by the method of the present invention. Thus, these samples could not be justly considered as effectively manifesting the properties of alloy composition. Though the strength could be increased by elongating the duration of the aging treatment, this method would not be efficient from the viewpoint of productivity. The samples produced with the temperature for the aging treatment set at a heightened level also exhibited low strength as compared with the samples produced by the method of the present invention. As respects the b* value which indicates the yellowish tint, these samples showed a large magnitude as compared with the samples of the present invention having an identical alloy composition. Thus, the methods used in Comparative Examples could not be justly concluded as most effectively producing alloys possessing strength equivalent to that of the 6063 alloy which has undergone the T5 treatment aimed at by the present invention and assuming an achromatic dark gray color in consequence of the anodizing treatment thereof.

EXAMPLE 3

An alloy of a varying composition shown in Table 5 below was casted in a hot top type casting furnace and subjected to a soaking treatment at 410° C. for seven hours.

The resultant soaked alloy billet was extruded at a billet temperature of 400° C. into an extruded article of a stated shape. This extruded article was subjected to an aging treatment at 190° C. for four hours and then quickly subjected to an anodizing treatment. This anodizing treatment was carried out by the use of a sulfuric acid bath. The conditions such as the concentration and the temperature of this bath and the current density used for the treatment, the pretreatment of the alloy, the treatment for sealing pores, etc. were in accordance with the method in popular practice. The treatment was adjusted so as to give a thickness of 20 $\mu$m to the anodic oxide film. The color tone assumed by a produced sample was reported in accordance with the method of indication specified in JIS Z 8729 and was rated on the basis of the definition mentioned above. As material characteristics, the resultant sample was tested for mechanical properties and the mechanical properties were rated in comparison with those of the 6063 alloy which has undergone the T5 treatment. As concerns the resistance of the anodic oxide film to corrosion, the sample was subjected to the CASS test as specified in JIS H 8601 and the results of the test were rated on the two-point scale, wherein an open circle, o, stands for resistance equivalent to the 6063 alloy which has undergone the T5 treatment and a cross, x, for resistance inferior thereto. The results are shown in Table 6.

TABLE 5

| Classification | No. | Si | Mg | Fe | Ti | B | Al |
|---|---|---|---|---|---|---|---|
| Invention | 1 | 0.9 | 0.3 | 0.15 | 0.1 | — | Balance |
| | 2 | 0.9 | 0.3 | 0.15 | 0.01 | — | " |
| | 3 | 0.9 | 0.55 | 0.15 | 0.005 | 0.02 | " |
| | 4 | 1.8 | 0.4 | 0.15 | 0.1 | 0.001 | " |
| | 5 | 1.8 | 0.4 | 0.15 | 0.01 | 0.01 | " |
| | 6 | 1.8 | 0.4 | 0.15 | 0.01 | 0.002 | " |
| | 7 | 1.8 | 0.4 | 0.15 | 0.005 | 0.02 | " |
| | 8 | 1.8 | 0.4 | 0.15 | 0.005 | 0.005 | " |
| | 9 | 3.0 | 0.4 | 0.15 | 0.1 | 0.001 | " |
| | 10 | 3.0 | 0.55 | 0.15 | 0.01 | 0.02 | " |
| | 11 | 3.0 | 0.6 | 0.10 | 0.01 | — | " |
| | 12 | 3.0 | 0.6 | 0.10 | 0.005 | — | " |

TABLE 6

| Classification | No. | Tensile strength, kgf/mm$^2$ | 0.2% Proof stress, kgf/mm$^2$ | Elongation, % | Color tone of produced anodic oxide film L* value | a* value | b* value | Resistance to Corrosion |
|---|---|---|---|---|---|---|---|---|
| Invention | 1 | 19.6 | 14.7 | 14.3 | 74.8 | −0.52 | 1.04 | ○ |
| | 2 | 19.4 | 14.6 | 14.6 | 74.6 | −0.50 | 1.10 | ○ |
| | 3 | 24.3 | 21.5 | 10.1 | 78.7 | −0.70 | 0.97 | ○ |
| | 4 | 24.7 | 20.7 | 12.9 | 62.3 | −0.23 | 1.20 | ○ |
| | 5 | 24.5 | 19.8 | 12.9 | 62.1 | −0.22 | 1.15 | ○ |
| | 6 | 24.3 | 20.5 | 12.9 | 62.7 | −0.23 | 1.20 | ○ |
| | 7 | 24.9 | 20.7 | 12.6 | 63.4 | −0.19 | 1.19 | ○ |
| | 8 | 24.7 | 20.5 | 11.2 | 62.3 | −0.23 | 1.25 | ○ |
| | 9 | 23.4 | 19.4 | 12.9 | 55.1 | 0.16 | 0.62 | ○ |
| | 10 | 24.1 | 20.5 | 12.0 | 52.6 | 0.03 | 0.59 | ○ |
| | 11 | 25.8 | 23.5 | 11.1 | 50.6 | 0.09 | 0.73 | ○ |
| | 12 | 25.6 | 23.7 | 11.3 | 50.8 | 0.11 | 0.67 | ○ |

It is clearly noted from Table 6 that the alloy extruded articles, Samples Nos. 1 through 12, according to the present invention had such magnitudes of strength as are equivalent to that of the 6063 alloy and were fully satisfactory in terms of proof stress and elongation. The L*, a*, and b* values (indexes of color tone) obtained of these extruded articles fell in the respective ranges specified by the present invention and the magnitudes of resistance to corrosion were satisfactory.

EXAMPLE 4

Of the alloy compositions of the present invention shown in Table 5, those of Nos. 3, 9, and 10 were manufactured under the conditions shown in Table 7 below into extruded articles. These extruded articles were tested for properties and the results were rated in the same manner as in Example 2. Incidentally, the anodizing treatment was carried out in the same manner as in Example 3. The results are shown in Table 8. In Table 8, the symbol ◎ indicates a particularly superior result.

TABLE 7

| Classification | No. | Alloy used, No. | Production conditions of extrusions: Soaking treatment (°C. × hr) | Billet heating temperature (°C.) | Aging treatment (°C. × hr) |
|---|---|---|---|---|---|
| Invention | 1 | 3 | 410 × 7 | 400 | 190 × 4 |
| | 2 | 3 | " | 380 | " |
| | 3 | 9 | 410 × 7 | 400 | 190 × 4 |
| | 4 | 9 | 380 × 10 | " | " |
| | 5 | 9 | 430 × 5 | " | " |
| | 6 | 9 | 410 × 7 | " | 180 × 5 |
| | 7 | 10 | 410 × 7 | 400 | 190 × 4 |
| | 8 | 10 | " | 450 | 200 × 3 |
| | 9 | 10 | " | " | 190 × 4 |
| | 10 | 10 | " | 380 | 170 × 7 |
| Comparative Example | 11 | 3 | 330 × 7 | 400 | 190 × 4 |
| | 12 | 9 | " | " | " |
| | 13 | 10 | " | " | " |
| | 14 | 3 | 500 × 7 | " | " |
| | 15 | 9 | " | " | " |
| | 16 | 10 | " | " | " |
| | 17 | 3 | 410 × 7 | 350 | " |
| | 18 | 9 | " | " | " |
| | 19 | 10 | " | " | " |

TABLE 8

| Classification | Sample No. | Alloy used, No. | Tensile strength kgf/mm$^2$ | 0.2% Proof stress, kgf/mm$^2$ | Elongation, % | Color tone of produced anodic oxide film L* value | a* value | b* value | Ratio by number % | Extrudability |
|---|---|---|---|---|---|---|---|---|---|---|
| Invention | 1 | 3 | 24.3 | 21.5 | 10.1 | 78.7 | 0.70 | 0.97 | 96 | ○ |
| | 2 | 3 | 23.6 | 20.9 | 10.6 | 77.6 | 0.61 | 1.13 | — | ○ |
| | 3 | 9 | 23.4 | 19.4 | 12.6 | 55.1 | 0.16 | 0.61 | — | ○ |
| | 4 | 9 | 22.2 | 18.7 | 13.2 | 54.9 | 0.18 | 0.72 | 91 | ○ |
| | 5 | 9 | 23.1 | 19.5 | 12.7 | 56.1 | 0.15 | 0.58 | — | ○ |
| | 6 | 9 | 22.7 | 19.4 | 12.6 | 55.2 | 0.16 | 0.62 | — | ○ |
| | 7 | 10 | 24.1 | 20.2 | 12.0 | 52.6 | 0.03 | 0.59 | 90 | ○ |
| | 8 | 10 | 23.2 | 18.9 | 13.1 | 53.1 | 0.07 | 0.67 | — | ◎ |
| | 9 | 10 | 24.3 | 20.2 | 11.9 | 52.4 | 0.02 | 0.63 | — | ◎ |
| | 10 | 10 | 22.7 | 19.5 | 12.5 | 51.9 | 0.11 | 0.71 | — | ○ |
| Comparative Example | 11 | 3 | 18.1 | 15.1 | 14.6 | 76.3 | 0.43 | 4.68 | 78 | ○ |
| | 12 | 9 | 17.4 | 14.9 | 14.9 | 43.2 | 0.07 | 5.23 | 81 | ○ |
| | 13 | 10 | 17.9 | 15.0 | 14.8 | 41.6 | 0.02 | 4.85 | 79 | ○ |
| | 14 | 3 | 27.1 | 25.5 | 11.7 | 79.5 | 0.51 | 2.33 | — | ○ |
| | 15 | 9 | 27.8 | 25.1 | 11.2 | 70.2 | 0.11 | 1.06 | — | ○ |
| | 16 | 10 | 27.4 | 25.0 | 10.8 | 68.4 | 0.13 | 0.95 | — | ○ |
| | 17 | 3 | 16.1 | 12.6 | 15.1 | 77.2 | 0.63 | 1.23 | — | X |
| | 18 | 9 | 15.9 | 13.1 | 15.3 | 53.3 | 0.11 | 0.83 | — | X |
| | 19 | 10 | 16.4 | 13.2 | 15.6 | 50.8 | 0.08 | 0.86 | — | X |

The samples produced by the method of the present invention and indicated as Samples, Nos. 1 through 10, in Table 8 exhibited mechanical properties equivalent to those of the 6063 alloy shown in Table 2, assumed color tones falling within the range specified by the present invention, and excelled in the extrudability which immensely affects the productivity.

In contrast, the samples, Nos. 11 through 13, of Comparative Examples adopted a low temperature for the soaking treatment, exhibited conspicuously large magnitudes for the b* value indicating yellowish tint as compared with those of the samples of the present invention, and assumed colors widely different from the achromatic gray color aimed at by the present invention. These differences originated in the fact that most precipitated metallic Si particles had diameters not exceeding 0.1 $\mu$m as mentioned above. Further, the samples of the Comparative Examples showed magnitudes of tensile strength 4 to 5 kgf/mm$^2$ lower than those of the samples of the present invention and could not be justly concluded as fully manifesting the properties of the extruded articles of the present invention having an identical alloy composition.

The samples, Nos. 14 through 16, were produced with the temperature of soaking treatment set at a high magnitude. Owing to the high temperature of treatment, the precipitated Si particles gained in growth and acquired large particle diameters and, as a result, the fine precipitated Si particles capable of contributing to the integral coloring proportionately decreased. Thus,the magnitudes of the L* value (indicating color density) exhibited by these samples were higher than those of the samples of the present invention (light color tone). This trend was especially conspicuous in the samples, Nos. 14 and 16, which showed differences in the L* value of not less than 10 from the samples (Nos. 1 and 7) of the present invention having an identical composition.

The samples, Nos. 17 through 19, were produced with the billet temperature set at a low magnitude during the course of extrusion. These samples were extremely deficient in the extrudability such that occasionally the relevant alloy billets even clogged the extruder. In consideration of actual production, the conditions of production adopted for these samples, therefore, were not proper in terms of productivity. As respects mechanical properties, the $Mg_2Si$ particles precipitated during the course of the soaking treatment could not be thoroughly redissolved in the alloy during the course of heating the billet. The samples, therefore, could not be made to acquire fully satisfactory strength even by the aging treatment performed at the final step.

As clearly demonstrated by the working examples cited above, the present invention allows production with high productivity of a high-strength extruded article of age-hardening aluminum alloy which educes stably with high reproducibility a dark gray color of an achromatic color tone whose psychometric lightness L* (lightness) and psychometric chroma coordinates a* (greenish to reddish tint) and b* (bluish to yellowish tint) expressed by the method of indicating the color of an object specified in JIS Z 8729 respectively fall in the ranges of $45<L^*<80$, $-1<a^*<1$, and $0<b^*<2$ in consequence of the anodic oxidation thereof. The extruded article of age-hardening aluminum alloy thus obtained possesses the heretofore unattainable strength equivalent to that of 6063 alloy which has undergone the T5 treatment specified in JIS A6063, educes the aforementioned achromatic dark gray color, and excels as in the resistance to corrosion. Thus, it finds utility advantageously in a wide range of applications such as, for example, building materials and proves unusually useful from the economic point of view.

While certain specific working examples have been disclosed herein, the invention may be embodied in other specific forms without departing from the spirit or essential characteristics thereof. The described examples are therefore to be considered in all respects as illustrative and not restrictive, the scope of the invention being indicated by the appended claims rather than by foregoing description and all changes which come within the meaning and range of equivalency of the claims are, therefore, intended to be embraced therein.

What is claimed is:

1. A building grade extruded article of an age-hardening aluminum alloy comprising: 0.9 to 3.0% by weight of Si, 0.3 to 0.6% by weight of Mg, less than 0.3% by weight of Fe, and the balance of Al and unavoidable impurities, which has undergone an extrusion processing comprising subjecting a billet of said alloy to a soaking treatment at a temperature in the range of from 350° to 480° C. for 2 to 12 hours, extruding the soaked alloy billet at a billet temperature in the range of from 380° to 450° C., and subjecting the extruded article to an aging treatment at a temperature in the range of from 170° to 200° C. for 2 to 8 hours, and which has precipitated metallic silicon particles uniformly distributed therein and including those of particle sizes in the range of from 0.1 to 2 μm in a proportion of not less than 85% of the total number of the precipitated particles and has the ability to emit a dark gray color of an achromatic color tone in consequence of an anodic oxidation thereof, the alloy having a psychometric lightness L* of less than 80.

2. The extruded article according to claim 1, wherein said achromatic dark gray color educed in consequence of said anodic oxidation is such that the psychometric lightness L* and the psychometric chroma coordinates a* and b* respectively fall in the ranges of $45<L^*<80$, $-1<a^*<1$, and $0<b^*<2$.

3. The extruded article according to claim 1, wherein the amount of silicon in said alloy is not less than 1.5 times the amount of magnesium by weight ratio.

4. An extruded article of an age-hardening aluminum alloy comprising 0.9 to 3.0% by weight of Si, 0.3 to 0.6% by weight of Mg, less than 0.3% by weight of Fe, 0.005 to 0.1% by weight of Ti either alone or in combination with 0.001 to 0.02% by weight of B, and the balance of Al and unavoidable impurities, which has undergone an extrusion processing comprising subjecting a billet of said alloy to a soaking treatment at a temperature in the range of from 350° to 480° C. for 2 to 12 hours, extruding the soaked alloy billet at a billet temperature in the range of from 380° to 450° C., and subjecting the extruded article to an aging treatment at a temperature in the range of from 170° to 200° C. for 2 to 8 hours, and which has precipitated metallic silicon particles uniformly distributed therein and including those of particle sizes in the range of from 0.1 to 2 μm in a proportion of not less than 85% of the total number of the precipitated particles and has the ability to emit a dark gray color of an achromatic color tone in consequence of an anodic oxidation thereof, the alloy having a psychometric lightness L* of less than 80.

5. The extruded article according to claim 4, wherein said achromatic dark gray color educed in consequence of said anodic oxidation is such that the psychometric lightness L* and the psychometric chroma coordinates a* and b* respectively fall in the ranges of $45<L^*<80$, $-1<a^*<1$, and $0<b^*<2$.

6. The extruded article according to claim 4, wherein the amount of silicon in said alloy is not less than 1.5 times the amount of magnesium by weight ratio.

7. An extruded article of an age-hardening aluminum alloy, the alloy emitting a dark gray color, the alloy comprising:

from about 0.9% to about 3.0% by weight Si, from about 0.3% to about 0.6% by weight Mg, the balance comprising Al and unavoidable impurities, the alloy having a psychometric lightness L* of less than 80, wherein the alloy further comprises precipitated particles including precipitated metallic Si particles uniformly distributed throughout the article, the precipitated metallic Si particles comprising greater than 85% of a total amount of precipitated particles in the article. the alloy being subjected to a soaking treatment at a soaking temperature of about 475° C. or less prior to extrusion of the alloy at an extrusion temperature of about 450° C. or less prior to age hardening of the alloy at an age hardening temperature of about 200° C. or less.

8. The article of claim 7 wherein said precipitated metallic Si particles have a particle diameter ranging from 0.1 μm to about 2 μm.

9. The article of claim 7 wherein the alloy is further characterized as having a ratio of Si to Mg of greater than 1.5.

10. The article or claim 7 wherein the alloy further comprises Ti in an amount ranging from about 0.005% by weight to about 0.1% by weight.

11. The article or claim 10 wherein the alloy further comprises B in an amount ranging from about 0.001% by weight to about 0.02% by weight.

12. The article of claim 7 wherein the dark gray color of the alloy is further characterized the psychometric lightness L* coordinate ranging from about 45 to about 80, a psychometric chroma coordinate a* ranging from about −1 to about 1 and a psychometric chroma coordinate b* ranging from about 0 to about 2.

13. The article of claim 7 wherein the alloy further comprises less than 0.3% by weight Fe.

* * * * *